US006453049B1

(12) United States Patent
Chu et al.

(10) Patent No.: US 6,453,049 B1
(45) Date of Patent: Sep. 17, 2002

(54) ACOUSTIC DIAPHRAGM

(75) Inventors: Pang-Chuan Chu; Hsiu-Yen Lee, both of Shanghai (CN)

(73) Assignee: GTI Audio Systems Internation Inc. (TW)

( * ) Notice: Subject to any disclaimer, the term of this patent is extended or adjusted under 35 U.S.C. 154(b) by 0 days.

(21) Appl. No.: 09/521,979

(22) Filed: Mar. 9, 2000

(30) Foreign Application Priority Data

Mar. 12, 1999 (CN) ..... 99225962 U
Mar. 12, 1999 (CN) ..... 99225963 U

(51) Int. Cl.[7] ..... H04R 25/00
(52) U.S. Cl. ..... 381/152; 381/191; 381/426; 381/431; 181/170
(58) Field of Search ..... 381/150, 152, 381/190, 191, 396, 423, 424, 425, 426, 431, FOR 152, FOR 163; 181/148, 157, 170, 168, 169

(56) References Cited

U.S. PATENT DOCUMENTS 4,808,202 A * 2/1989 Nishikawa et al. ..... 381/152
4,907,207 A * 3/1990 Moeckl ..... 381/190
6,097,829 A * 8/2000 Guenther et al. ..... 381/425
6,123,171 A * 9/2000 McNett et al. ..... 181/290

* cited by examiner

*Primary Examiner*—Curtis Kuntz
*Assistant Examiner*—Suhan Ni
(74) *Attorney, Agent, or Firm*—Peter F. Corless; Steven M. Jensen; Edwards & Angell, LLP

(57) ABSTRACT

An acoustic diaphragm arranged to face a driving device of a loudspeaker is disclosed. The acoustic diaphragm comprises at least one laminated structure, one of which includes a first carbon fiber layer, a glue layer formed on the first carbon fiber layer, and a second carbon fiber layer formed on the glue layer. The acoustic diaphragm of the present invention has small distortion of sound, less deformation by external force, better stereo, and sound quality, as compared with a conventional diaphragm.

3 Claims, 5 Drawing Sheets

ACOUSTIC DIAPHRAGM

FIELD OF THE INVENTION

The present invention relates to an acoustic diaphragm, and more particularly to an improved acoustic diaphragm having a light weight, thin thickness, small distortion of sound, less deformation by external force, and better sound quality.

BACKGROUND OF THE INVENTION

At the present stage, a conventional acoustic diaphragm used in a loudspeaker is made of thin paper or chemical fiber. However, those materials are readily affected by the external environment such as temperature or moisture, thereby causing deterioration in the sound quality and disadvantageously decreasing the characteristics of the acoustic diaphragm.

Generally, those conventional acoustic diaphragms have two kinds of shapes, including cone-shaped diaphragm and inversely cone-shaped diaphragm. A driving device of the loudspeaker can provide a sound wave signal to vibrate the acoustic diaphragm so as to allow sound to travel in the air. However, there are several defects occurred in such conventional acoustic diaphragms. The above-mentioned acoustic diaphragm must be incorporated with a sound box to generate resonance so as to have a euphonious sound travel in the air. Besides, in order to obtain a high quality sound, it is necessary that the above-mentioned acoustic diaphragms have the characteristics of light weight and thin thickness. If the acoustic diaphragms can't meet those requirements, the driving device of the loudspeaker may be unable to make diaphragms vibrate due to less power. On the other hand, the acoustic diaphragms made of such material are easily broken when it is formed into a thin one. Therefore, it is not easy to provide a suitable acoustic diaphragm which meets these requirements all together. Moreover, the sound travelling from above-mentioned cone-shaped acoustic diaphragm or inversely cone-shaped acoustic diaphragm is generated from one source point located in the arc-shaped surface of the acoustic diaphragm, i.e. a point sound source. A loudspeaker utilizing the above-mentioned acoustic diaphragm is limited to one direction so that the sound respectively traveling from two opposite faces of the acoustic diaphragm has an extremely different effect. It is therefore tried by the applicant to deal with the above situation encountered by the prior art.

SUMMARY OF THE INVENTION

It is therefore an object of the present invention to provide an acoustic diaphragm for obtaining high-quality sound without needing any sound box.

It is a further object of the present invention to provide an acoustic diaphragm having light weight and thin thickness, which is not easy to be broken.

It is another object of the present invention to provide an acoustic diaphragm which can be formed into any geometric diaphragm.

It is another yet object of the present invention to provide an acoustic diaphragm having a plane sound source so that the sound respectively travelling from two opposite faces of the acoustic diaphragm has same effect.

It is another further object of the present invention to provide an acoustic diaphragm arranged to face a driving device of a loudspeaker. The acoustic diaphragm includes at least one laminated structure, one of which includes a first carbon fiber layer, a glue layer formed on the first carbon fiber layer, and a second carbon fiber layer formed on the glue layer.

Certainly, the acoustic diaphragm can be any geometric diaphragm. Preferably, the acoustic diaphragm is a panel-shaped diaphragm.

Preferably, the driving device is mounted at a specific position facing the acoustic diaphragm. More preferably, the specific position relative to said acoustic diaphragm is located at an intersection of a vertical line passing a point which is 3/11 of the distance form a center of gravity of the acoustic diaphragm to one side edge of the acoustic diaphragm, and a horizontal line passing a point which is 2/9 of the distance from the center of gravity to one of the upper and lower edges.

In a specific embodiment of the present invention, an acoustic diaphragm is arranged to face a driving device of a loudspeaker. The acoustic diaphragm includes at least one laminated structure, one of which includes a first paper layer, a first glue layer formed on the first paper layer, a plastic material layer formed on the first glue layer, a second glue layer formed on the plastic material layer, and a second paper layer formed on the second glue layer.

It is another object of the present invention to provide a loudspeaker assembly. The loudspeaker assembly comprises an acoustic diaphragm having at least one laminated structure, one of which includes a first carbon fiber layer, a glue layer formed on the first carbon fiber layer, and a second carbon fiber layer formed on the glue layer, and a driving device arranged to face the acoustic diaphragm for providing a sound wave signal to vibrate the acoustic diaphragm so as to allow sound to travel in the air.

Certainly, the acoustic diaphragm can be any geometric diaphragm. Preferably, the acoustic diaphragm is a panel-shaped diaphragm.

Preferably, the driving device is mounted at a specific position facing the acoustic diaphragm. More preferably, the specific position relative to said acoustic diaphragm is located at an intersection of a vertical line passing a point which is 3/11 of the distance form a center of gravity of the acoustic diaphragm to one side edge of the acoustic diaphragm, and a horizontal line passing a point which is 2/9 of the distance from the center of gravity to one of the upper and lower edges.

It is further an object of the present invention to provide a loudspeaker assembly. The loudspeaker assembly comprises an acoustic diaphragm having at least one laminated structure, one of which includes a first paper layer, a first glue layer formed on the first paper layer, a plastic material layer formed on the plastic material layer, a second glue layer formed on the plastic material layer, a second paper layer formed on the second glue layer, and a driving device arranged to face the acoustic diaphragm for providing a sound wave signal to vibrate the acoustic diaphragm so as to allow sound to travel in the air.

The present invention may best be understood through the following descriptions with reference to the accompanying drawings, in which:

DETAILED DESCRIPTION OF THE PREFERRED EMBODIMENTS

Figure 1:
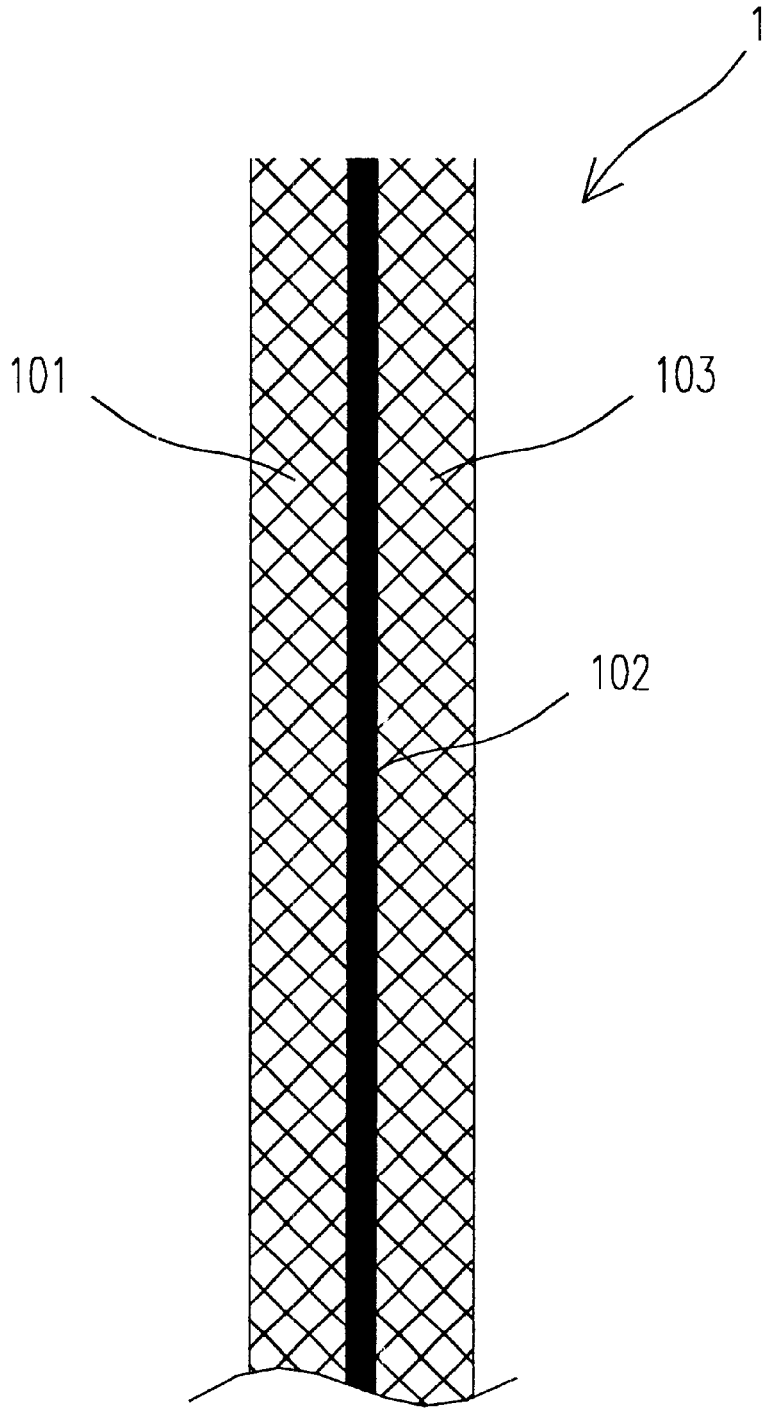
FIG. 1 is a side view showing a first preferred acoustic diaphragm according to the present invention.

Referring now to the drawing, FIG. 1 illustrates a side view of a first preferred acoustic diaphragm according to the present invention. As shown in FIG. 1, the acoustic diaphragm 1 has a laminated structure. The laminated structure includes a first carbon fiber layer 101, a glue layer 102 formed on the first carbon fiber layer 101, and a second carbon fiber layer 103 formed on the glue layer 102. The process for producing the above-mentioned acoustic diaphragm will be described now. First, a thin first carbon fiber layer 101 is provided. Then, the first carbon fiber layer 101 is coated with a glue layer 102 on one surface thereof and a thin second carbon fiber layer 103 is attached to the glue layer 102 opposite to the first carbon fiber layer 101. Finally, within a specific time and at a specific temperature and pressure, the laminated structure including the first carbon fiber layer 101, the glue layer 102 and the second carbon fiber 103 is thermoset into an acoustic diaphragm with a required size and shape. The resulting acoustic diaphragm 1 can be formed into a panel-shaped diaphragm or any geometric diaphragm. Although an acoustic diaphragm having one laminated structure is described herein, it will be appreciated that an acoustic diaphragm having two or more such laminated structures can be constructed in accordance with the present invention. Thus, the above-described acoustic diaphragm can be readily modified to one with two or more laminated structures.

Figure 2A:
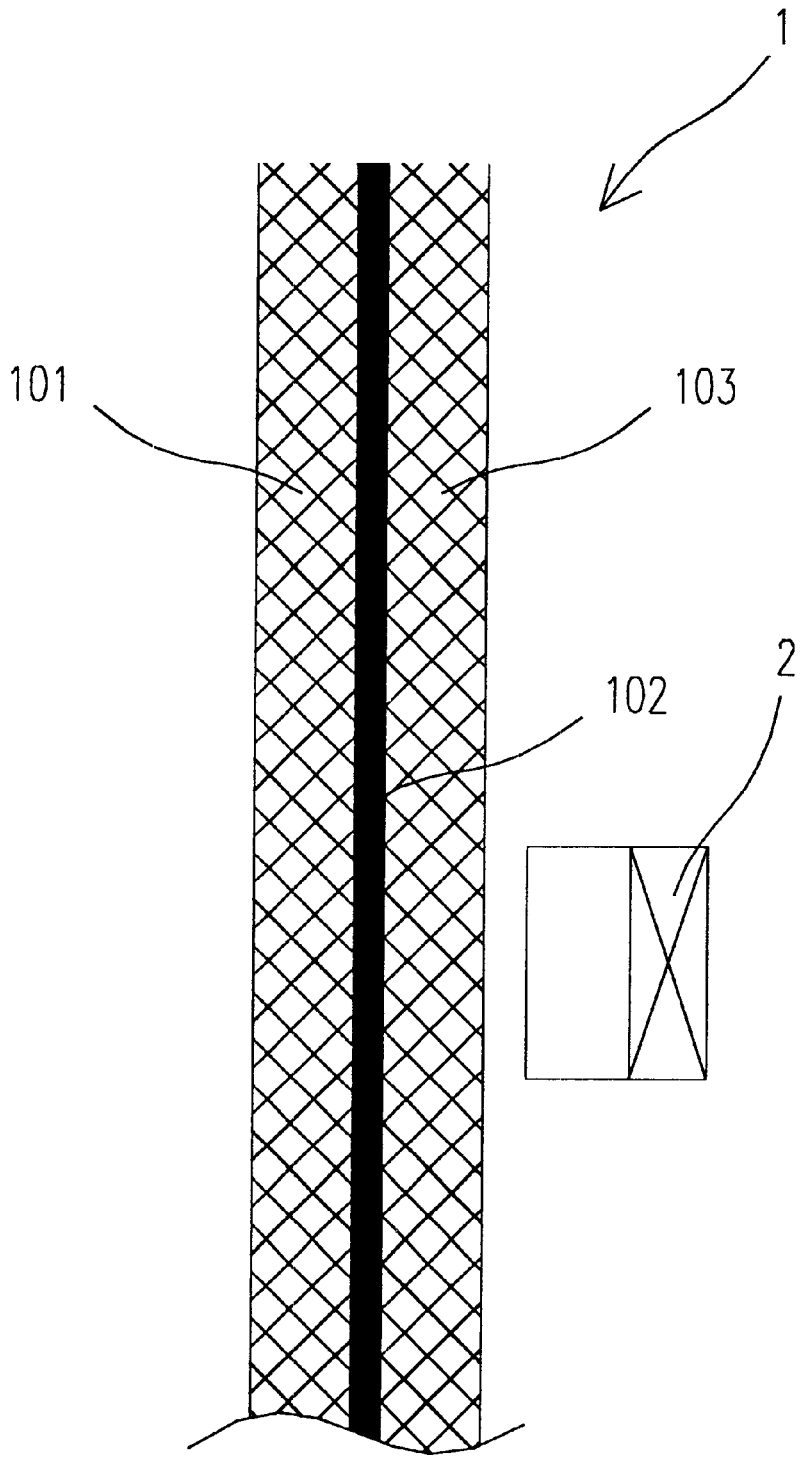
FIG. 2A is a schematic diagram showing an assembly of the first preferred acoustic diaphragm and a driving device according to the present invention.
Figure 2B:
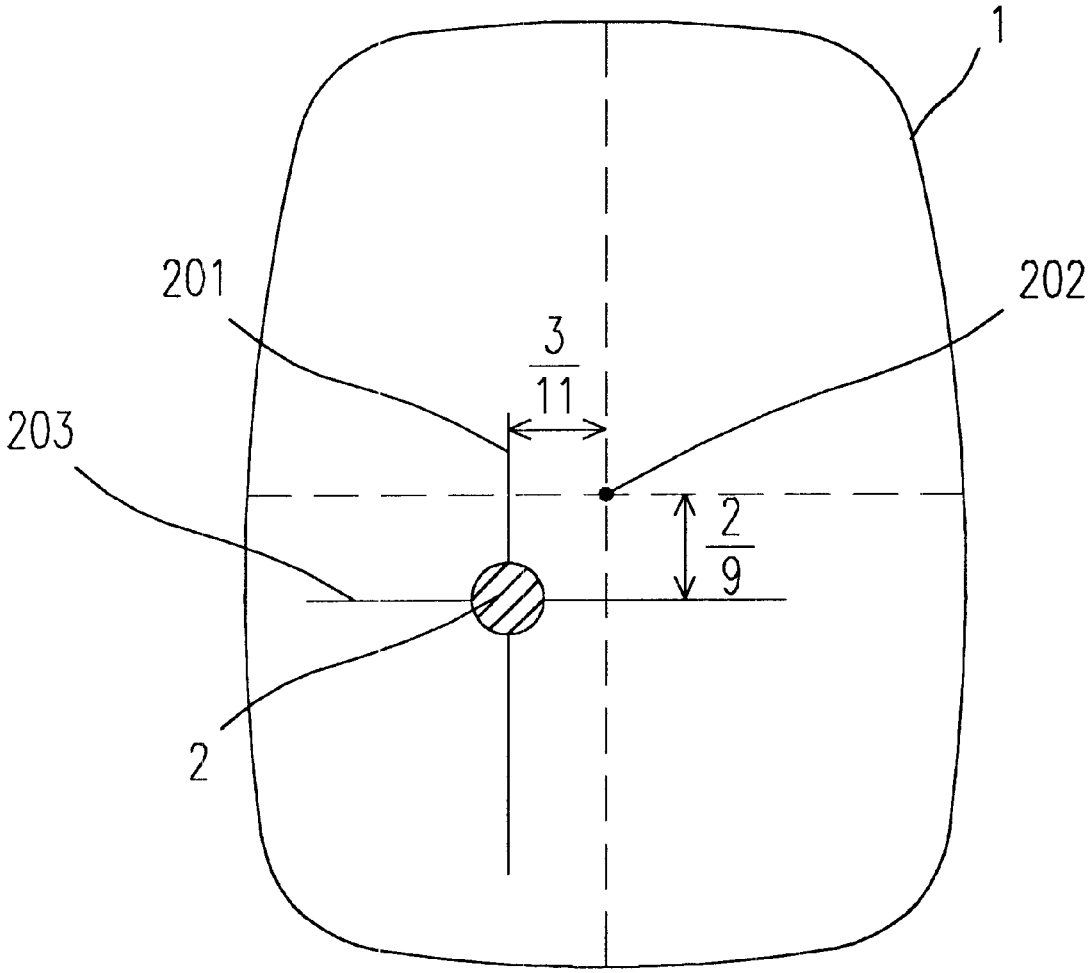
FIG. 2B is a schematic diagram showing a preferred position of the driving device relative to the acoustic diaphragm according to the present invention.

Please refer to FIG. 2A which shows an assembly of the first preferred acoustic diaphragm and a driving device according to the present invention. As shown in FIG. 2A, a driving device 2 is mounted at a specific position facing the above-mentioned acoustic diaphragm 1. Please refer to FIG. 2B. The most suitable position of the driving device 2 relative to the acoustic diaphragm 1 is located at an intersection of a vertical line 201 passing a point which is 3/11 of the distance from the center of gravity 202 of the acoustic diaphragm to one side edge of the acoustic diaphragm, and a horizontal line 203 passing a point which is 2/9 of the distance from the center of gravity 202 to one of the upper and lower edge of the acoustic diaphragm. Although the assembly having one driving device is described herein, it will be appreciated that two or more driving devices can be constructed respectively at those suitable positions relative to the acoustic diaphragm in accordance with the present invention. Thus, the above-described assembly can be readily modified to one with two or more driving devices.

Figure 3:
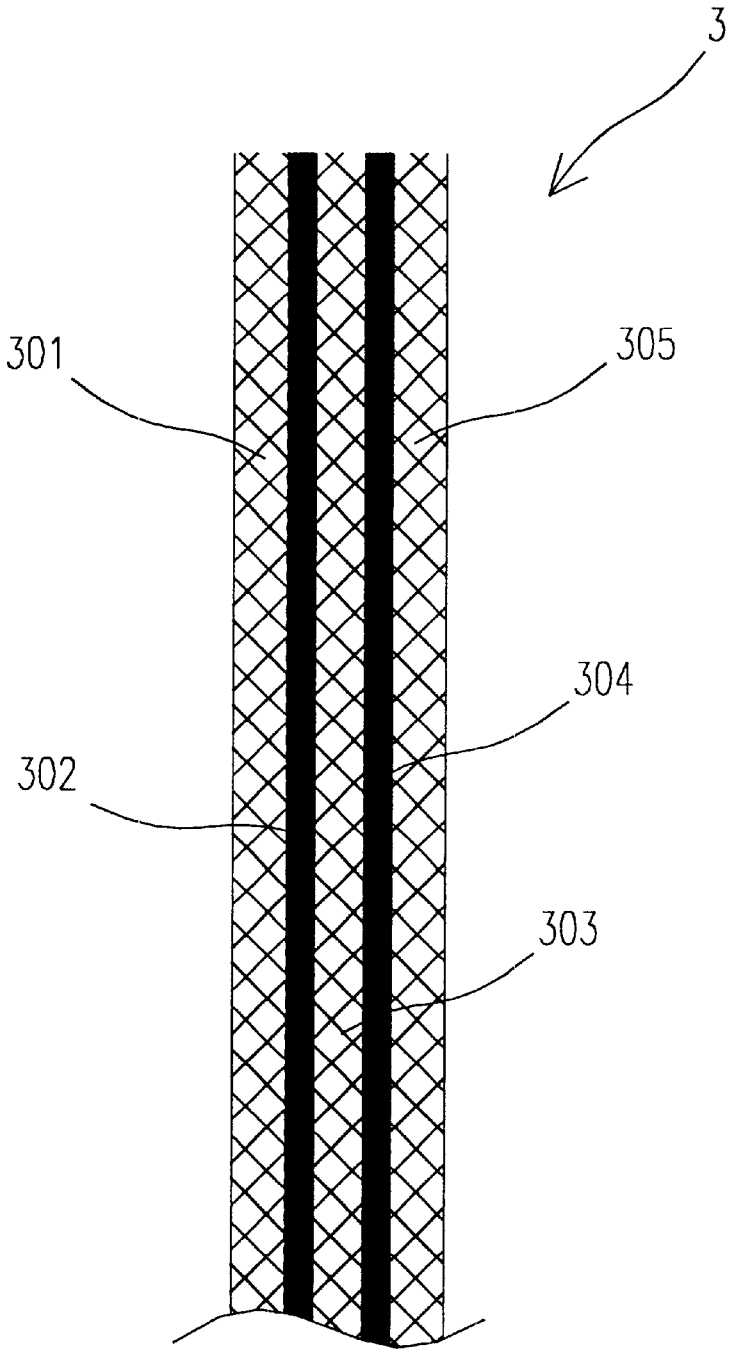
FIG. 3 is a side view showing a second preferred acoustic diaphragm according to the present invention.

Please refer to FIG. 3 which shows a side view of a second preferred acoustic diaphragm according to the present invention. As shown in FIG. 3, the acoustic diaphragm 3 has a laminated structure. The laminated structure includes a first paper layer 301, a first glue layer 302 formed on the first paper layer 301, a plastic material layer 303 formed on the first glue layer 302, a second glue layer 304 formed on the plastic material layer 303, and a second paper layer 305 formed on the second glue layer 304. The process for producing the above-mentioned acoustic diaphragm is the same as that described in previous embodiment. The resulting acoustic diaphragm can also be formed into a panel-shaped diaphragm or any geometry-shaped diaphragm. Although an acoustic diaphragm having one laminated structure is described herein, it will be appreciated that an acoustic diaphragm having two or more such laminated structures can be constructed in accordance with the present invention. Thus, the above-described acoustic diaphragm can be readily modified to one with two or more laminated structures.

Figure 4:
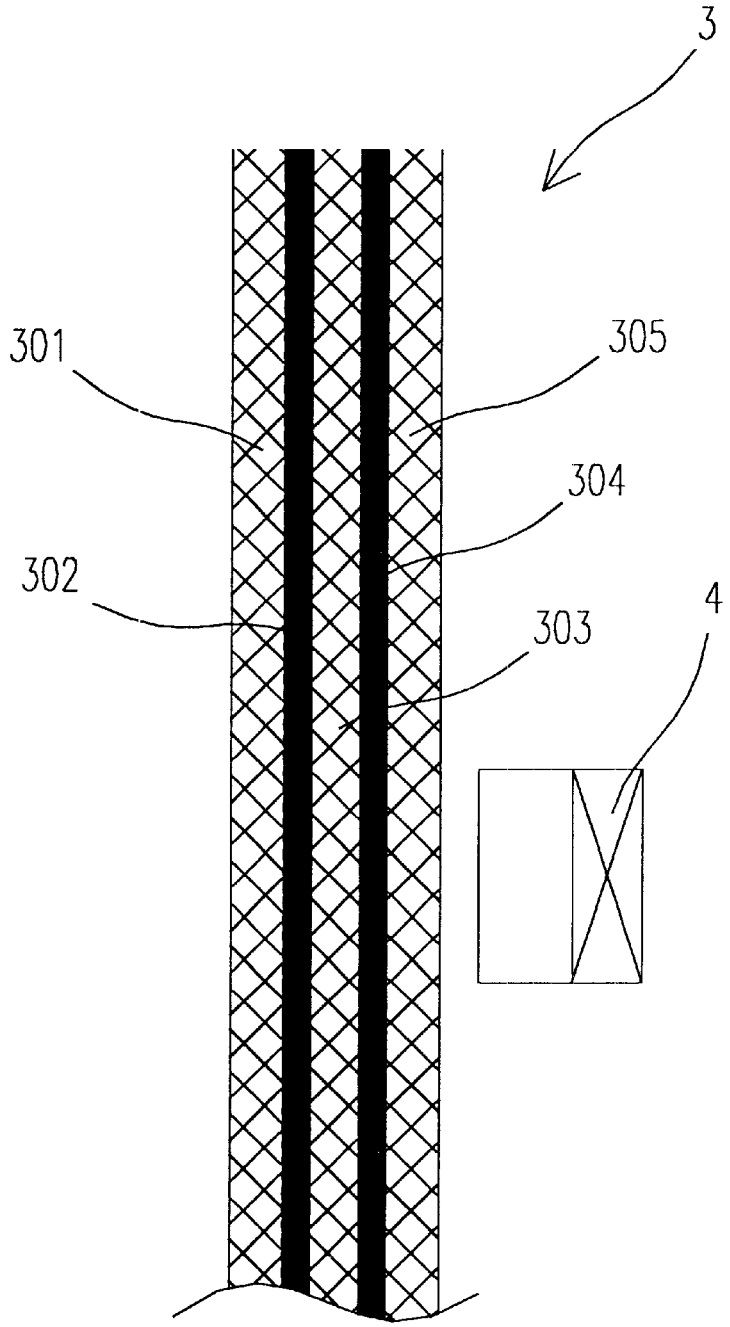
FIG. 4 is a schematic diagram showing an assembly of the second preferred acoustic diaphragm and a driving device according to the present invention.

Please refer to FIG. 4 which shows an assembly of the second preferred acoustic diaphragm and a driving device according to the present invention. As shown in FIG. 4, a driving device 4 is mounted at a specific position facing the above-mentioned acoustic diaphragm 3. The most suitable position of the driving device 4 relative to the acoustic diaphragm 3 is located at an intersection of a vertical line passing a point which is 3/11 of the distance from the center of gravity of the acoustic diaphragm to one side edge of the acoustic diaphragm, and a horizontal line passing a point which is 2/9 of the distance from the center of gravity to one of the upper and lower edge of the acoustic diaphragm. Although the assembly having one driving device is described herein, it will be appreciated that two or more driving devices can be constructed respectively at those suitable positions relative to the acoustic diaphragm in accordance with the present invention. Thus, the above-described assembly can be readily modified to one with two or more driving devices.

The acoustic diaphragm according to the present invention has small distortion of sound, less deformation by external force, better stereo, and sound quality, as compared with a conventional diaphragm. In addition, the acoustic diaphragm of the present invention has enough strength so that it is not easy to be affected by the external environment such as temperature or moisture, thereby keeping the sound quality in good level for a longer time. Moreover, the acoustic diaphragm of the present invention can be formed into any geometric diaphragm for providing a face sound source so that the sound respectively travelling from two opposite faces of the acoustic diaphragm has same effect. Therefore, the acoustic diaphragm is more advantageous than the conventional acoustic diaphragm.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What We claim is:

1. A loudspeaker assembly, comprising:

an acoustic diaphragm having at least one laminated structure, one of which includes a first carbon fiber layer, a glue layer formed on said first carbon fiber layer, and a second carbon fiber layer formed on said glue layer; and a driving device arranged to face said acoustic diaphragm for providing a sound wave signal to vibrate said acoustic diaphragm so as to allow sound to travel in the air, wherein said driving device faces said acoustic diaphragm at an intersection of a vertical line passing a point which is 3/11 of the distance from a center of gravity of said acoustic diaphragm to one side edge of said acoustic diaphragm, and a horizontal line passing a point which is 2/9 of said distance from said center of gravity to one of the upper and lower edges.

2. The acoustic diaphragm according to claim 1, wherein said acoustic diaphragm is a panel-shaped diaphragm.

3. A loudspeaker assembly, comprising:

an acoustic diaphragm having at least one laminated structure, one of which includes a first paper layer, a first glue layer formed on said first paper layer, a plastic material layer formed on said first glue layer, a second glue layer formed on said plastic material layer, and a second paper layer formed on said second glue layer; and a driving device arranged to face said acoustic diaphragm for providing a sound wave signal to vibrate said acoustic diaphragm so as to allow sound to travel in the air, wherein said driving device faces said acoustic diaphragm at an intersection of a vertical line passing a point which is 3/11 of the distance from a center of gravity of said acoustic diaphragm to one side edge of said acoustic diaphragm, and a horizontal line passing a point which is 2/9 of said distance from said center of gravity to one of the upper and lower edges.

* * * * *